United States Patent [19]

Meissen et al.

[11] 4,320,395

[45] Mar. 16, 1982

[54] ALPHA-NUMERIC-DISPLAY SYSTEM WITH SELECTABLE CRAWL

[75] Inventors: Ralf Meissen; Friedrich Löser; Joachim Berwix; Christof Krischer, all of JUM/u/ lich, Fed. Rep. of Germany

[73] Assignee: Kernforschungsanlage Jülich Gesellschaft mit beschränkter Haftung, Jülich, Fed. Rep. of Germany

[21] Appl. No.: 128,521

[22] Filed: Mar. 10, 1980

[30] Foreign Application Priority Data

Mar. 12, 1979 [DE] Fed. Rep. of Germany ..... 2909660

[51] Int. Cl.[3] ..... G09G 1/16

[52] U.S. Cl. ..... 340/726; 340/731; 178/30

[58] Field of Search ..... 340/726, 724, 723, 731; 178/30, 15

[56] References Cited

U.S. PATENT DOCUMENTS

| | | | |
|---|---|---|---|
| 3,406,387 | 10/1968 | Werme | 340/726 |
| 3,611,348 | 10/1971 | Rogers | 340/726 |
| 3,653,027 | 3/1972 | Scheer | 340/726 |
| 3,891,792 | 6/1975 | Kimura | 340/726 |

FOREIGN PATENT DOCUMENTS 2028344 3/1974 Fed. Rep. of Germany .

*Primary Examiner*—Marshall M. Curtis

*Attorney, Agent, or Firm*—Karl F. Ross

[57] ABSTRACT

A television-type system for displaying characters of an alpha-numeric test in a horizontal line moving across the face of a TV monitor includes pulse-generator-fed frequency dividers emitting pulse sequences of which three are transmitted via viewer-operated selectors for forming two frequencies $f_L$ and $f_Z$ applied to shift registers of a character generator to determine character height and width and another frequency $f_G$ applied to the stepping input of a delay-increment counter to determine character speed. In response to character codes transmitted from an input unit via a read/write memory, the character generator emits binary signals combinable with horizontal and vertical sync pulses into a video signal fed to the monitor. The counter is reset upon every horizontal sync pulse to have a modulus n equal to the contents of a total-delay counter stepped by the vertical sync pulses and reset after N of the same by a divder calculating the quotient $N=T_Z/T_G$ in response to signals from the selectors coding the periods $T_Z$, $T_G$ of sequences $f_Z$, $f_G$. The delay-increment counter enables the emission of frequency $f_Z$ only after counting n pulses of sequence $f_G$, whereby the character display is shifted leftwardly upon each vertical sync pulse by distance corresponding to period $T_G$. Upon completing N counts the total-delay counter enables its own resetting by the divider and increments an initial address of a counter addressing the read/write memory. An arithmetic unit resets the contents n of the total-delay counter upon a change in the selected sequence $f_G$.

10 Claims, 6 Drawing Figures

ALPHA-NUMERIC-DISPLAY SYSTEM WITH SELECTABLE CRAWL

FIELD OF THE INVENTION

Our present invention relates to a television-type system for displaying an alpha-numeric text. In particular, our invention relates to such a system in which sequential characters of the text move horizontally across the TV screen at a speed selected by the viewer.

BACKGROUND OF THE INVENTION

Systems are known, such as that described in U.S. Pat. No. 3,614,766 issued Oct. 19, 1971 to James M. Kievit, in which a digitally encoded text is displayed on the screen or face of a raster-equipped TV monitor. Generally, the viewer is able to choose the text he wishes to read. The text is entered into temporary storage by an input device such as a teletype or cassete-tape player and subsequently decoded by a character generator into binary signals combinable with horizontal and vertical sync pulses to form a video signal transmitted to the receiving terminals of the TV monitor.

The known display systems, whether of the television type or of the LED or liquid-crystal type, are only limitedly adaptable to the individual needs of different viewers. Some systems have a fixed character size, while others offer only one or a few relatively high rates of character motion.

OBJECTS OF THE INVENTION

An object of our present invention is to provide a method for displaying alpha-numeric characters in a horizontally moving sequence on a TV monitor, wherein the speed and dimensions of the characters are readily variable.

Another object of our present invention is to provide a system of the above-described type, wherein character speed and dimensions are selectable in accordance with the needs of the individual viewer, particularly the visually handicapped viewer.

SUMMARY OF THE INVENTION

In a method for displaying the characters of an alpha-numeric text in a horizontal line on the face or screen of a television monitor, wherein the sequential characters are induced to move across the monitor face in a fixed spatial relationship to one another, the characters are prestored in a coded form and subsequently decoded into binary signals combined with horizontal and vertical sync pulses and fed to the receiving terminals of the monitor for effectuating the character display. Signals corresponding to a first character in a horizontal scan of the monitor's energization beam are emitted only upon the elapse of a delay following the horizontal sync pulses, while the characters have on the monitor face a common width corresponding to a horizontal scanning interval $T_Z$ substantially less than the interval between consecutive horizontal sync pulses.

An improvement of this method comprises, according to our present invention, the steps of generating a frequency $f_G$ which is at least equal to the reciprocal of the scanning interval $T_Z$ and successively decreasing, upon the vertical sync pulses, the delay time by an increment $T_G$ to implement character motion, this increment being equal to the period of the frequency $f_G$. Preferably, the frequency $f_G$ is equal to an integral multiple of a horizontal-sampling frequency $f_Z$ which controls the character width and whose period is equal to the scanning interval $T_Z$; the delay time is decreased upon each of a plurality of consecutive vertical sync pulses to effect, in the horizontal position of each character on the monitor face, a total shift corresponding to an integral multiple of the scanning interval $T_Z$.

According to an other feature of our present improvement, a plurality of frequencies $f_G'$ equal to respective integral multiples of the sampling frequency $f_Z$ are generated, one of these frequencies being selected to serve as frequency $f_G$, whereby the speed of the characters across the monitor face may be varied. It is advantageous for interval $T_Z$ to be an integral multiple of increment $T_G$.

A television display system according to our present invention comprises a TV monitor with a viewing face or screen, a memory for storing a sequence of characters of an alpha-numeric text to be displayed in a moving horizontal line across the monitor face, and a pulse generator for producing horizontal sync pulses, vertical sync pulses and a pulse train having a period less than the interval between consecutive horizontal sync pulses. A character generator operatively connected to the memory emits in response to signals therefrom binary pulses transmittable to the monitor in combination with the vertical and horizontal sync pulses for producing the character display, such combination being effected by transmission means possibly including a video mixer. An addresser is linked to the memory for sequentially reading consecutive character codes therefrom to the character generator. A control circuit is operatively coupled to the character generator for enabling, during each horizontal scan or cycle of the monitor, the emission of the character-generating binary pulses only upon the elapse of a delay following the horizontal sync pulses. The control circuit includes a delay modifier connected to the pulse generator for recurrently decreasing, upon the vertical sync pulses, the delay by an increment equal to the period of the pulse train, whereby the delay is changed from an upper limit to a lower limit to effectuate motion of the alpha-numeric characters across the monitor face. The control circuit further includes an address incrementer connected to the addresser for modifying an initial address thereof (i.e. generated thereby) upon the attainment of the lower limit by the delay time and to the delay modifier for simultaneously increasing the delay to the upper limit. The characters are decoded by the character generator to have on the monitor face a common width corresponding to a horizontal scanning interval preferably equal to an integer multiple of the pulse-train period.

According to another feature of our present invention, the pulse generator produces a high-frequency pulse signal energizing a frequency divider for feeding to the character generator a pulse sequence for enabling the emission of the character-coding binary signals to the monitor and for determining the character width. The control circuit is connected to the frequency divider for disabling, upon the horizontal sync pulses, the emission of the pulse sequence for a time equal to the delay and for calculating, in response to the pulse train and to a signal generated at an output of the divider for coding the magnitude of the horizontal scanning interval, an increment count necessary to change the delay from the upper limit to the lower limit.

According to yet another feature of our present invention, the frequency divider has a first section for determining character width and a second section for determining the speed of character motion across the monitor face. A first selector is inserted between the first divider section and the character generator for varying the frequency of the pulse sequence, whereby the character width is adjusted; a second selector is inserted between the second divider section and the control circuit for varying the frequency of the pulse train, whereby the character speed is changed.

According to further, more particular, features of our present invention, the delay modifier includes a first counter connected at a stepping input to the pulse generator for changing, upon the vertical sync pulses, the magnitude of the delay and a second counter connected to the pulse generator and to the first counter for being reset upon each horizontal sync pulse to have a modulus equal to the numerical value of the contents of the first counter. The second counter is connected at a stepping input to the second selector and at an output to the first frequency-divider section for enabling the same to emit frequency divided pulse sequences to the first selector upon the counting by the second counter of a number of train pulses equal to the counter modulus.

The control circuit also includes an arithmetic divider connected to the first and second selector and to the first counter for changing the modulus thereof in response to changes in the frequency of the pulse train and the pulse sequence, thereby minimizing display jitter or jumps in character movement.

Pursuant to another particular feature of our present invention, the first counter has an output extending to the addresser for incrementing an initial address thereof (i.e. generated thereby) upon the counting of consecutive vertical sync pulses equal in number to the modulus of the first counter. Preferably, the characters are generated to have a common character width corresponding to a horizontal scanning interval equal to an integral multiple of the pulse-train period and the lower limit of the delay is zero.

It is noted that a display system according to our present invention is readily adaptable to the needs of the individual viewer and that the character motion is effectuated by a change in delay upon every vertical sync pulse (every 20 msec in a 50 Hz system). A change in character speed is caused by varying the delay increment size ($T_G$), rather than the number of increments counted.

BRIEF DESCRIPTION OF THE DRAWING

These and other features of our present invention will now be described in detail, reference being made to the accompanying drawing in which.

SPECIFIC DESCRIPTION

Figure 1:
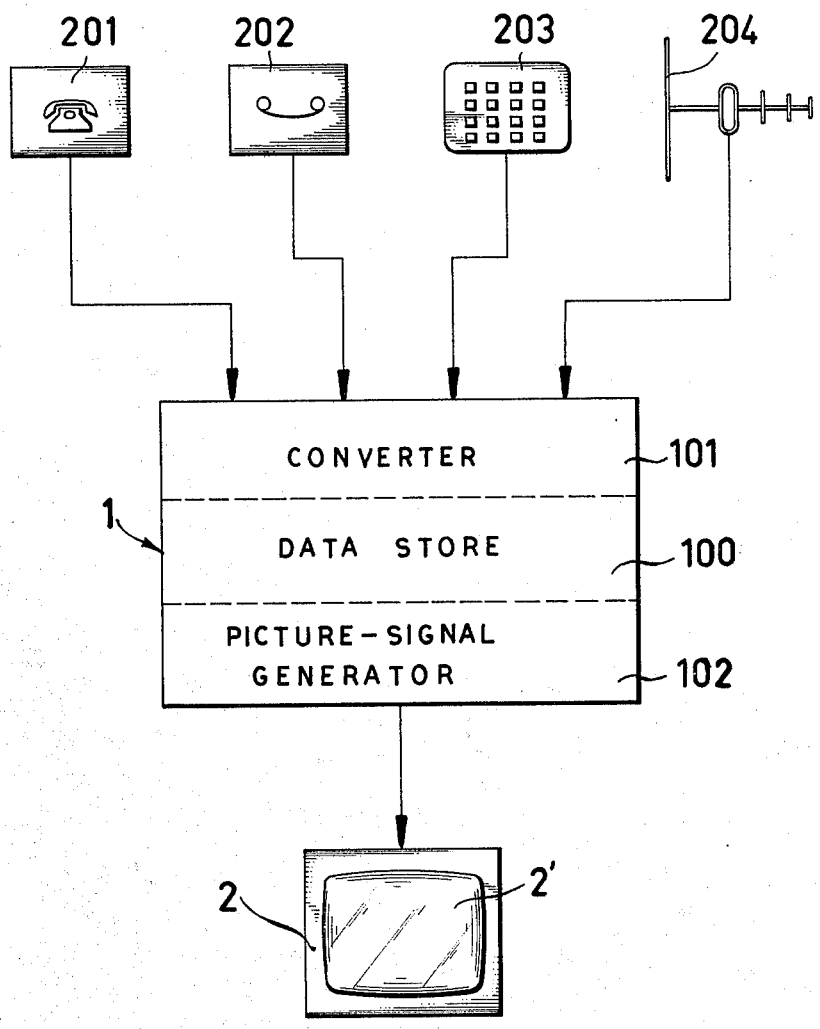
FIG. 1 is a block diagram of a television-type display system including a picture-signal generator according to our present invention, connected to a TV monitor.

As shown in FIG. 1, a device 1 according to our present invention for displaying alpha-numeric characters in a moving sequence arranged horizontally on the face 2' of a television monitor 2 includes a data store 100 loadable with coded sequential characters of an alpha-numeric text transmitted via a signal converter or interface 101 from a digital-signal source such as a telephone 201, a magnetic-tape cassette 202, a teletype 203 or a receiving antenna 204 of a television system. The text is converted by a picture-signal generator 102 (see FIG. 3) into a video signal transmittable to the receiving terminals of raster-equipped TV monitor 2 for effectuating the display of the text on face or screen 2'.

Figure 2:
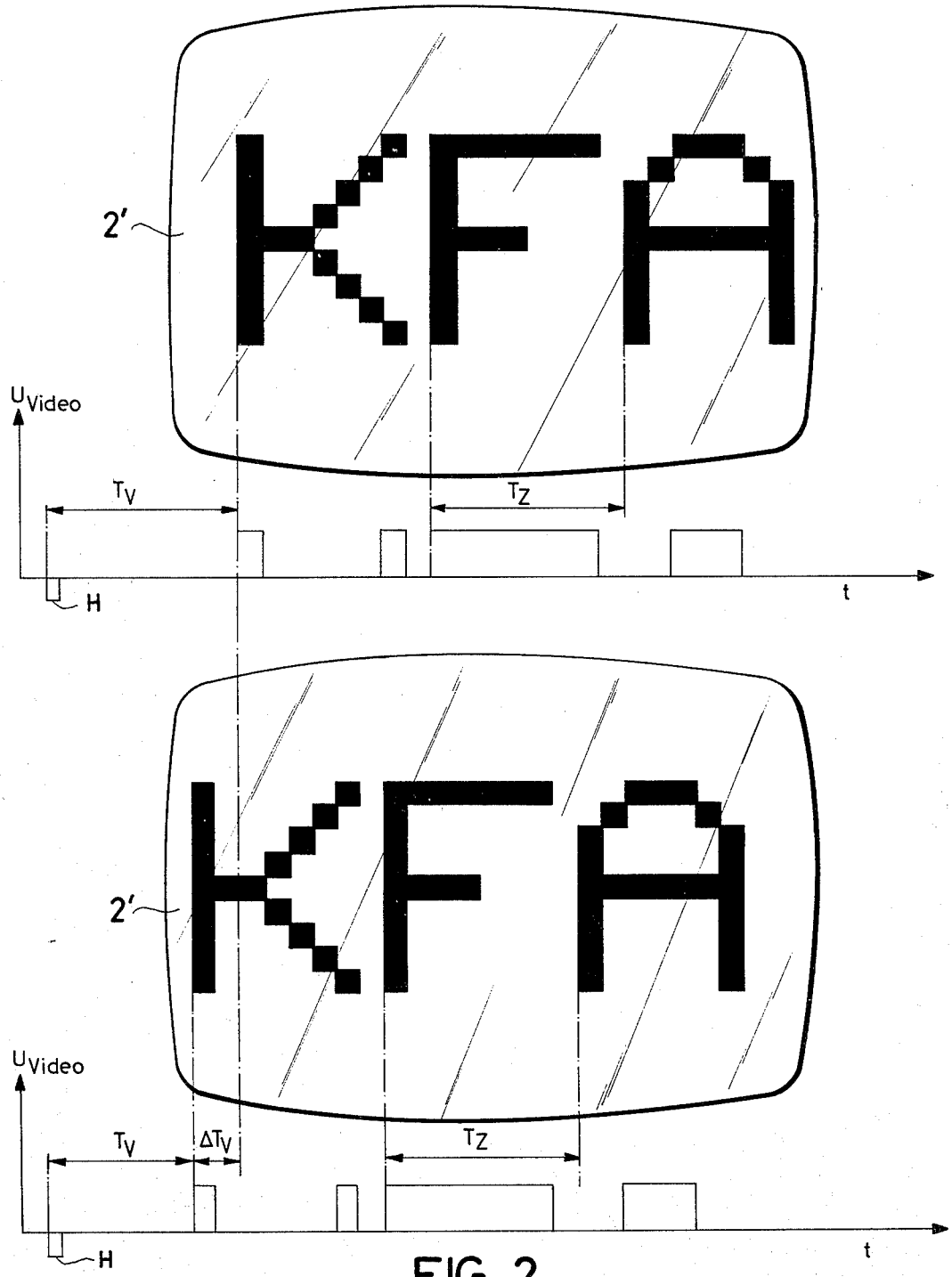
FIG. 2 is a pair of graphs indicating motion of alpha-numeric characters across a screen or face of the monitor shown in FIG. 1, such motion being produced by the generator of FIG. 1.

Movement of a single line of alpha-numeric characters from right to left across screen 2' is indicated in the two graphs of FIG. 2. It is well known that the energization of screen 2' is caused by an electron beam with a vertical and a horizontal sweep synchronized by vertical and horizontal sync pulses V and H, respectively. As indicated in a top graph of FIG. 2, a sequence of characters KFA each having on screen 2' a width corresponding to a horizontal scanning interval or time $T_Z$ have, upon a first vertical sync pulse $V_O$, a position defined by a delay interval $T_V$ between the horizontal sync pulses H and subsequent emissions of character-coding pulses in a video signal $U_{Video}$ transmitted from generator 102 (FIG. 1) to monitor 2. Upon an ensuing vertical sync pulse $V_1$, this delay is decreased by an increment $\Delta T_V$, whereby the positions of the characters K,F,A are shifted to the left by a distance corresponding to this increment. The $U_{Video}$-vs-time graphs of FIG. 2 show the video signal for an uppermost horizontal line or row for which there is a non-zero video output, i.e. for the row corresponding to the tops of characters K, F, A.

Figure 3:
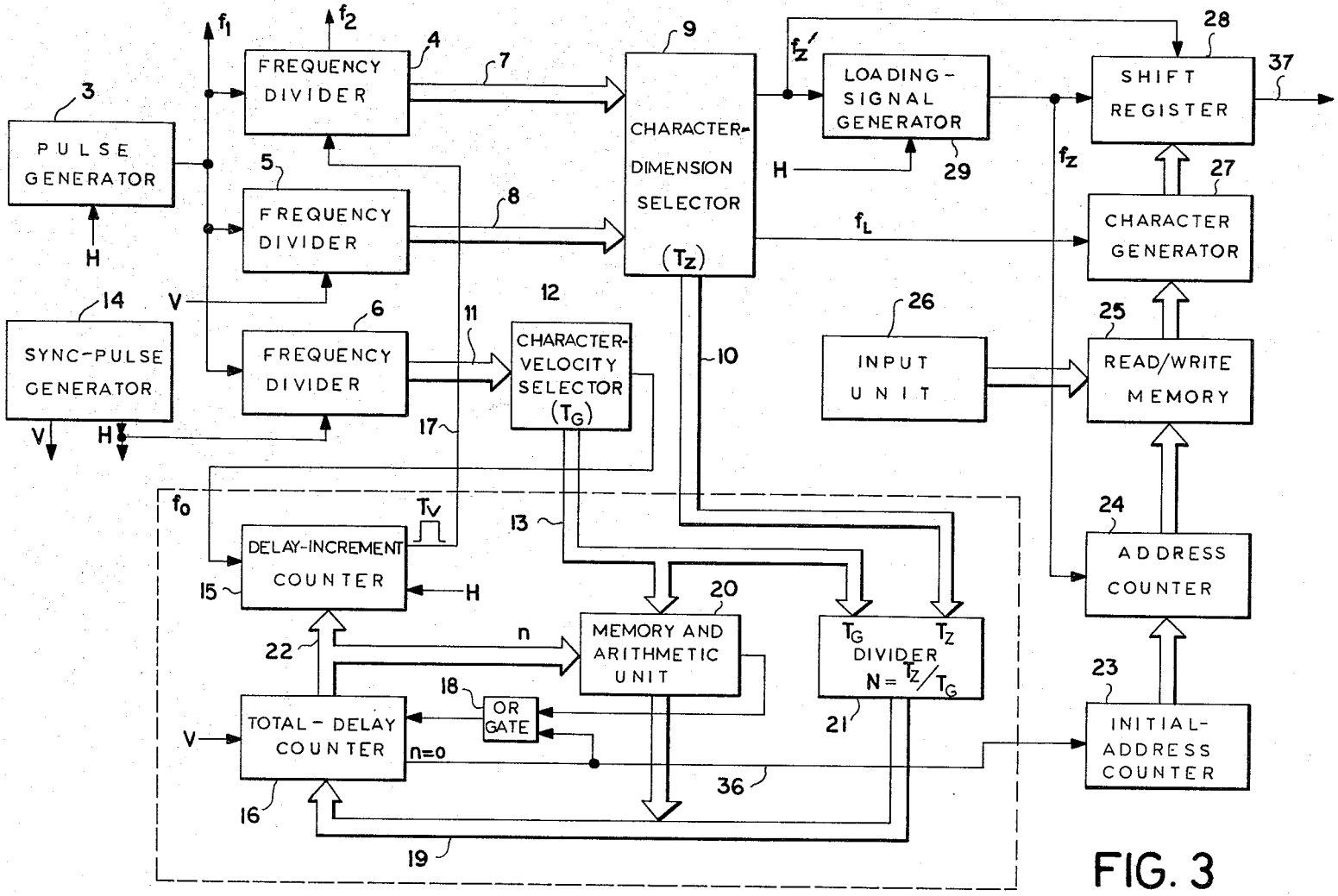
FIG. 3 is a block diagram of the generator of FIG. 1, showing an input unit for feeding character codes to a character generator via a read/write memory.

As shown in FIG. 3, video- or picture-signal generator 102 comprises, according to our present invention, a pulse generator 3 emitting a high-frequency pulse train $f_1$ to three frequency dividers 4, 5, 6. Dividers 4 and 5 have output multiples 7 and 8 extending to a selector circuit 9 which transmits, under manual control, a signal present on a lead of multiple 7 and a signal present on a lead of multiple 8 to form respective output pulse sequences $f_Z'$, $f_L$. Selector circuit 9 also generates on the leads of a multiple 10 a plurality of bits coding the period $T_Z$ of a sequence $f_Z$ whose frequency is a predetermined submultiple of frequency $f_Z'$. Divider 6 feeds a multiplicity of pulse trains via a multiple 11 to another selector circuit 12 which, in response to manual controls (not shown), selects one of these incoming trains to form a pulse sequence or frequency $f_G$. This train $f_G$ has a period $T_G$ coded by circuit 12 in a plurality of binary signals emitted over a multiple 13. Frequency dividers 5 and 6 are respectively synchronized by vertical and horizontal sync pulses V and H transmitted from a sync pulse generator 4.

Sequence $f_G$ is fed to the stepping input of a counter 15 connected at a resetting or enabling input to the horizontal-sync output of generator 14 and at a modulus-loading input to another counter 16; counter 15 has an output 17 extending to divider 4 for disabling the emission of signals thereby during delay interval $T_V$, as described more fully hereinafter. Counter 16 has a stepping input receiving the vertical sync pulses V from generator 14, a resetting or enabling input connected to an OR gate 18 and a modulus-loading input tied via a multiple 19 to a pair of arithmetic units 20, 21. Unit 21 is essentially a divider receiving over multiples 10 and 13 digitally coded periods $T_Z$ and $T_G$ and calculating a quotient $N=T_Z/T_G$ therefrom, the result being emitted onto multiple 19. Unit 20 includes, in addition to division circuitry, a memory connected to multiple 13 and to an output multiple 22 of counter 16 for storing the value of period $T_G$ and the contents n of counter 16; upon a change in the selected frequency $f_G$, unit 20 divides the value of the newly selected period $T_{G2}$ into the stored value $T_{G1}$, multiplies the resulting quotient by contents n, rounds this product to the nearest integer and emits the rounded product onto multiple 19, while simultaneously enabling counter 16, via OR gate 18, to load the product-coding bits present on multiple 19.

Figure 5:
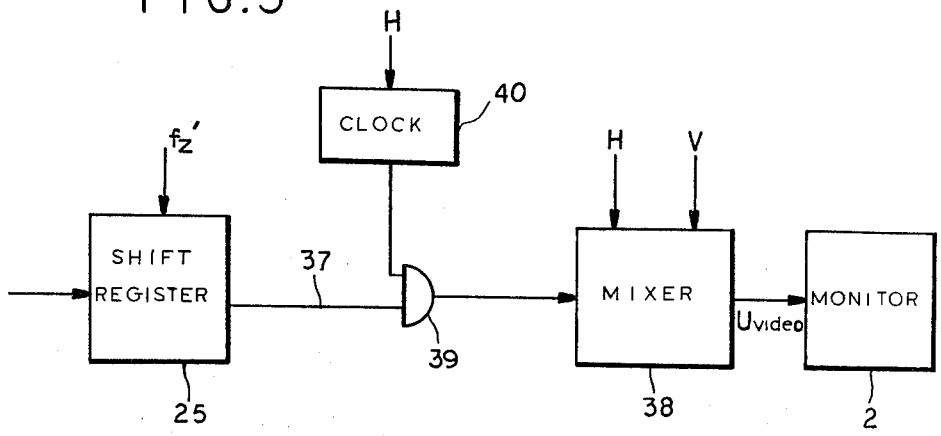
FIG. 5 is a block diagram of circuit components inserted between an output shift register of the generator shown in FIGS. 1 and 3 and the monitor shown in FIG. 1.

Video-signal generator 102 further comprises a cascaded pair of counters 23, 24 feeding addresses and concomitant reading commands to a random-access or read/write memory 25 loaded by an input unit 26 and feeding sequential character codes to a character generator 27, this generator in turn loading a shift register 28. Counter 23 is stepped by a signal carried by a lead 36 from counter 16 and indicating the completion of a counting cycle therein, while counter 24 is stepped by sequence $f_Z$ which is produced by a signal generator 29 in response to sequence $f_Z'$. This generator is synchronized by the horizontal sync pulses H and includes frequency-division means for decreasing the frequency of sequence $f_Z'$ by a predetermined factor X equal to the minimum number of bits required to code all the luminosity changes in a row of a character matrix. As shown in FIG. 5 of the above-identified patent, such a matrix may include fourteen rows and twelve columns, the luminosity value (either dark or light) at any of the 14X12 points of the matrix being specified by a bit in read/write memory 25; in this case, frequency $f_Z'$ is twelve times frequency $f_Z$.

Figure 4:
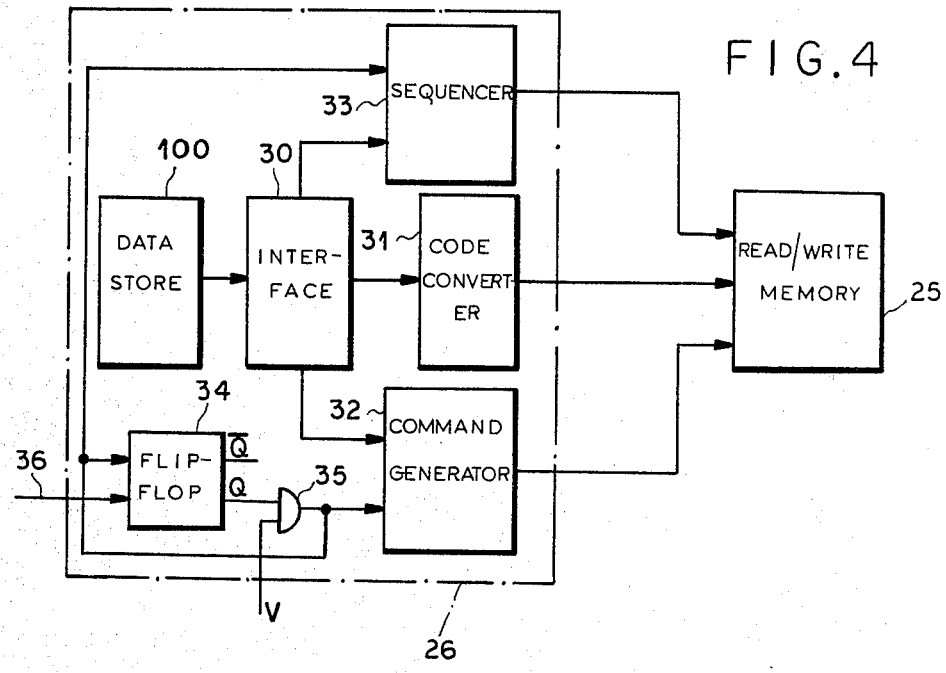
FIG. 4 is a block diagram of the input unit of FIG. 3.

As illustrated in FIG. 4, input 26 includes interface circuits 30 and a code converter 31 inserted between data store 100 and read-write memory 25 for loading the same with sequential character codes. Memory 25 is connected at a writing input to a command-signal generator 32 and at an address input to a sequencer 33, these units 32, 33 receiving conditioning signals from interface 30 and an enabling signal from the noninverted output Q of a flip-flop 34 via an AND gate 35. Flip-flop 34 has a setting input tied to lead 36 and a resetting input connected to gate 35, this gate having an input lead extending from the sync-pulse generator 14 for receiving the vertical sync pulses V. A pulse on lead 36 sets flip-flop 34 to enable, upon the reception of an ensuing vertical sync pulse by AND gate 35, the emission of an address by sequencer 33 and a concomitant writing command from generator 32. Memory 25 consequently loads the character code present at the output of converter 31, while sequencer is advanced by one address. It is also possible to control the loading of memory 25 by a circuit including components such as the cursor and line counters and the data input control shown in FIG. 2 of U.S. Pat. No. 3,614,766.

Shift register 28 has an output lead 37 extending to a video mixer 38 via an AND gate 39 connected at an input to a clock 40 synchronized with generator 14 (see FIG. 3) to emit between consecutive horizontal sync pulses a quantity of clock pulses substantially equal to the number of photosensitive points or phospore dots in a horizontal line or row on screen 2'. Mixer 38 combines the binary pulse output from gate 39 with the horizontal and vertical sync pulses H and V to produce video signal $U_{Video}$ which is transmitted to the receiving terminals of monitor 2.

Figure 6:
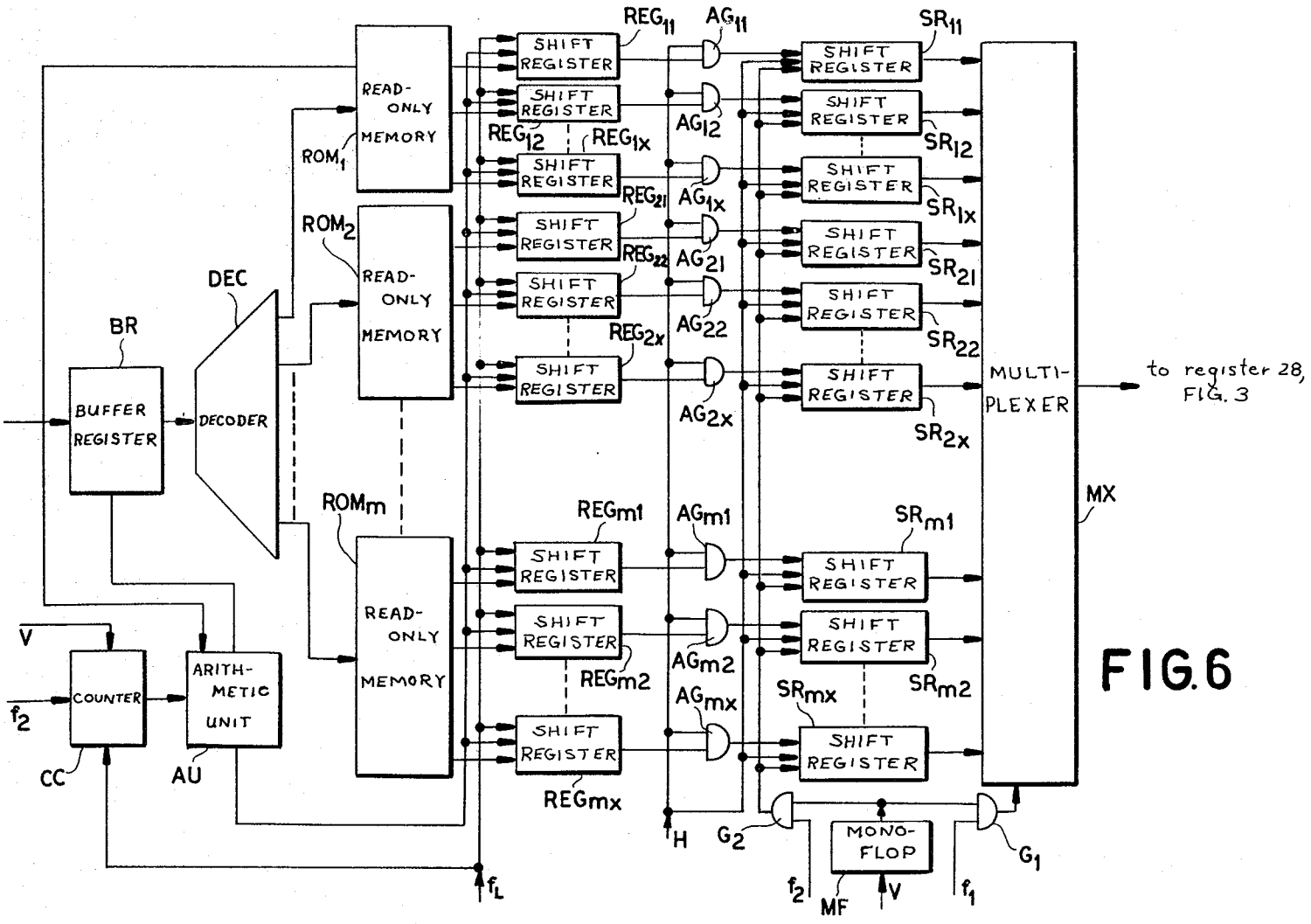
FIG. 6 is a block diagram of the character generator shown in FIG. 3.

As shown in FIG. 6, character generator 27 essentially comprises m read-only memories $ROM_1$–$ROM_m$, where m is greater than the maximum number of characters displayable on TV screen 2' (if there are 336 phospore dots per line and 12 bits in a horizontal line of a character matrix, maximum m will be greater than twenty-eight). The read-only memories are simultaneously addressed by respective character codes at the beginning of a vertical scanning cycle, these codes being sequentially loaded from memory 25 into a buffer register BR in response to address-stepping pulses $f_Z$ during an immediately preceding vertical scanning cycle. The codes temporarily stored in buffer register BR are distributed to respective read-only memories $ROM_1$–$ROM_m$ via a series-to-parallel converter or decoder DEC.

Memories $ROM_1$–$ROM_m$ each have X outputs working into respective shift registers $REG_{11}$–$REG_{1X}$, $REG_{21}$–$REG_{2X}$ . . . $REG_{m1}$–$REG_{mX}$ in turn feeding respective AND gates $AG_{11}$–$AG_{1X}$, $AG_{21}$–$AG_{2X}$ . . . $AG_{m1}$–$AG_{mX}$, where X is the number of columns in a character-coding matrix (twelve in the above-mentioned example). Let us assume that such a matrix has Y rows. Then, in response to the character codes or addresses from read/write memory 25, memories $ROM_1$–$ROM_m$ emit a series of Y brightness-coding bits to each register $REG_{11}$–$REG_{mX}$ fed by a memory $ROM_1$–$ROM_{mX}$ which has been addressed by a character code at the beginning of a current vertical scanning cycle. Generally, the lower frequency $f_Z$, the fewer the energized read-only memories.

Shift registers $REG_{11}$–$REG_{mX}$ have loading inputs tied to an arithmetic unit AU which receives from a counter CC a signal coding the period of pulse sequence $f_L$. Counter CC has count-starting and count-stopping inputs energizable by consecutive pulses of train $f_L$ and a count-stepping input tied to frequency divider 4 (FIG. 3) for receiving a signal $f_2$ in order to measure the interval between consecutive pulses of train $f_L$. Each vertical sync pulse V enables counter CC to emit its contents to unit AU which thereupon loads registers $REG_1$–$REG_{mX}$ with a common number of low-level bits proportional to the height of an upper blank area on screen 2', i.e. to the height of the nonenergized substantially rectangular region above the row of alphanumeric characters. Thus, counter CC and unit AU serve to vertically center the alpha-numeric display on screen 2'. It is to be noted that the number of bits transmitted by unit AU is proportional to the frequency of sequence $f_L$.

Upon the emission of bits determining the height of the upper blank zone, arithmetic unit AU enables buffer register BR to address read-only memories $ROM_1$–$ROM_m$ via decoder DEC, memory $ROM_1$ signaling to unit AU the completion of shift-register loading operations by the read-only memories. Unit AU then emits to registers $REG_{11}$–$REG_{mX}$ bits of low logic level for a lower blank zone on screen 2' (see FIG. 2). During the ensuing vertical scanning cycle, the contents of registers $REG_{11}$–$REG_{mX}$ are periodically shifted in response to pulse sequence $f_L$ to emit to AND gates $AG_1$-

$1-AG_{mX}$ sequential bits coding the luminosity values of successive rows in a TV raster juxtaposed to screen 2'. The lower the frequency of sequence $f_L$, the longer the time that each luminosity-coding logic value is present at the respective AND-gate input and the greater the number of bits of similar logic level that are loaded into shift registers $SR_{11}-SR_{1X}$, $SR_{21}-SR_{2X}$ . . . $SR_{mX}-SR_{mX}$ in response to horizontal sync pulses H. By means of shift registers $REG_{11}-REG_{mX}$ and $SR_{11}-SR_{mX}$ and gates $AG_{11}-AG_{mX}$ pulse sequence $f_L$ controls the vertical height of the alpha-numeric characters displayed on monitor screen 2'.

At the beginning of a vertical scanning cycle, the vertical sync pulse V triggers a monoflop MF to enable a pair of AND gates $G_1$ and $G_2$ to pass high-frequency pulse trains $f_1$ *l and* $f_2$ (see FIG. 3), respectively, to a multiplexer MX and to shift registers $SR_{11}-SR_{mX}$ for loading register 28 (FIG. 3) with the contents of registers $SR_{11}-SR_{mX}$, generated during the preceding vertical scanning cycle. The widths of the characters are determined by the frequency of pulse sequence $f_Z'$; successive logic levels are applied to an input of gate 39 (FIG. 5) for respective time intervals equal to the period of sequence $f_Z'$, whereby the number of horizontally adajcent phosphore dots energized according to the same bit level is determined. From the functions of sequences $f_Z'$ and $f_L$ is is clear that selector 9 (FIG. 3) implements operator- or viewer-controlled variation of the horizontal and vertical character dimensions, respectively.

A first pulse of sequence $f_Z'$ during a horizontal scanning cycle appears only upon the elapse of delay time $T_V$ (see FIG. 2) following the horizontal sync pulse. A delay-decrementing cycle begins with delay $T_V$ set at a maximum value or upper limit $T_{Vmax}$; upon each of N succeeding vertical sync pulses delay $T_V$ is decreased by increments $\Delta T_V$, until the delay attains a lower limit $T_{Vmin}$, whereupon the delay is reset at $T_{Vmax}$. Preferably, limit $T_{Vmin}$ is zero and there are an integral number of delay increments $\Delta T_V$ in any total delay $T_V$. Thus:

$$T_V = n \cdot \Delta T_V \text{ and} \quad (1)$$

$$T_{Vmax} = N \cdot \Delta T_V \quad (2)$$

wherein n=1, 2 . . . N. It is also preferable that upper limit $T_{Vmax}$ be equal to an integral multiple of horizontal scanning time or period $T_Z$ and, more particularly, exactly to this period:

$$T_{Vmax} = T_Z \quad (3)$$

whereby each delay-decrementing cycle is associated with the leftward shift on screen 2' of the generated alpha-numeric display by exactly one character width. In other words, upon the completion of the N vertical scanning cycles in one delay-decrementing cycle, a new character has appeared at the right of the screen while a previously leading character has disappeared to the left of the screen.

The above-described delay change is effectuated or controlled by counters 15 and 16. The contents n of unit 16 are the number of delay decrements $\Delta T_V$ to be counted by unit 15 upon each horizontal synch pulse during a current vertical scanning cycle. The number N of counts undertaken by unit 16 in response to vertical sync pulses V during a delay-decrementing cycle is determined prior to the start thereof by signals transmitted from divider 21 over multiple 19 and received by unit 16 under the control of an enabling or resetting pulse available at the output of OR gate 18 owing to a pulse emitted on lead 36 by counter 16 upon the attainment of zero-level contents n thereby.

Upon each horizontal sync pulse H, unit 15 loads the contents n of unit 16 and then decrements this number n by a unit in response to each pulse of stepping signal $f_G$. Unit 15 emits an enabling signal to frequency generator 4, as heretofore described, upon counting n pulses of signal $f_G$. Because the number n, which forms the modulus of counter 15, is lowered by one upon each vertical sync pulse V, the change in the total delay $T_V$ effected by counters 15, 16 from one vertical scanning cycle to the next, i.e. delay increment $\Delta T_V$, is equal to the period $T_G$ of stepping signal $f_G$:

$$\Delta T_V = T_G. \quad (4)$$

From equations (2), (3) and (4) we get the quotient:

$$N = T_Z / T_G. \quad (5)$$

This quotient is the quantity calculated and encoded by divider 21 in response to signals transmitted from selectors 9 and 12 over multiples 10 and 13. It is clear from equation (4) that the rate at which alpha-numeric characters move across the screen 2' is proportional to period $T_G$ and, therefore, inversely proportional to the frequency of signal $f_G$. Whereas component 9 is a character-dimension selector, component 12 is a character-velocity selector.

As heretofore described, in order to reduce or eliminate display jitter or character jumps due to a change in the output of velocity selector 12 during a delay-decrementing cycle, memory and arithmetic unit 20 calculates the integer-rounded result n' of the equation:

$$n' = n \cdot (T_{G1} / T_{G2}) \quad (6)$$

and replaces the contents n of counter 16 by this result n'. It ia also possible to provide circuitry in unit 20 for compensating a change in character width due to a change in the output frequency $f_Z'$ of dimension selector 9. In this case, unit 20 also memorizes period $T_Z$ and, in response to a change in this period, calculates an integer-rounded result n'' of the equation:

$$n'' = n \cdot (T_{Z2} / T_{Z1}) \quad (7)$$

where parameters $T_{Z1}$ and $T_{Z2}$ are the values of period $T_Z$ before and after the selector-output change, respectively.

It is to be noted that in a display system according to our present invention, the character speed can be made infinitesimally small and can be reduced to zero by blocking the vertical sync pulses V at the stepping input of counter 16. Such blocking can be conventionally implemented via an AND gate fed by the output of a viewer-operated pushbutton (not shown). A viewer-activated pulse generator (not shown) may be connected to decrementing and incrementing inputs of counter 23 for replaying or advancing the character display on screen 2' by respectively decreasing or increasing the initial-address contained in this counter.

We claim:

1. In a method for displaying an alpha-numeric text in a horizontal line on a face of a television monitor, wherein sequential characters of said text move across said face in a fixed spatial relationship to one another, said characters being prestored in coded form and subsequently decoded into binary signals combined with horizontal and vertical sync pulses and fed to the receiving terminals of said monitor for effectuating the display of said text, signals corresponding to a first character in a horizontal scan being emitted only upon the elapse of a delay time following said horizontal sync pulses, said characters having on said face a common apparent character width correponding to a horizontal-scanning interval $T_Z$ substantially less than an interval between consecutive horizontal sync pulses, the improvement comprising the steps of:

generating a frequency $f_G$ which is at least equal to the reciprocal of said interval $T_Z$; and successively decreasing, upon said vertical sync pulses, said delay time by an increment $T_G$ to implement motion of said characters across said face, said increment $T_G$ being equal to the period of said frequency $f_G$ and controlling said width by application of a horizontal sampling frequency $f_Z$ whose period is equal to said interval $T_Z$, said frequency $f_G$ being an integral multiple of said sampling frequency $f_Z$.

2. The improvement defined in claim 1 wherein said delay time is decreased upon each of each of a plurality of consecutive vertical sync pulses to effect in the apparent location of each character a total horizontal shift corresponding to an integral multiple of said interval $T_Z$.

3. The improvement defined in claim 2, further comprising the steps of generating a plurality of frequencies $f_G'$ equal to respective integral multiples of said sampling frequency $f_Z$ and selecting one of said frequencies $f_G'$ to serve as said frequency $f_G$, whereby the speed of said characters across said face may be varied.

4. The improvement defined in claim 1, 2 or 3 wherein said interval $T_Z$ is an integral multiple of said increment $T_G$.

5. In a television display system, the combination comprising:

a TV monitor having a viewing face;

memory means for storing a sequence of characters of an alpha-numeric text to be displayed in a moving horizontal line on said face;

pulse-generating means for producing horizontal sync pulses, vertical sync pulses and a pulse train having a period less than the interval between consecutive horizontal sync pulses;

a character generator operatively connected to said memory means for emitting in response to signals therefrom binary pulses transmittable to said monitor in synchronous combination with said horizontal sync pulses and said vertical sync pulses for producing on said face a display of said characters;

transmission means connected to said character generator, to said pulse-generating means and to said monitor for feeding thereto said binary pulses and said horizontal sync pulses and said vertical sync pulses;

addressing means linked to said memory for sequentially reading consecutive character codes therefrom to said character generator; and a control circuit operatively coupled to said character generator for enabling, during each horizontal scan by said monitor, the emission of said binary pulses only upon the elapse of a delay following said horizontal sync pulses, said control circuit including delay-modification means connected to said pulse-generating means for recurrently decreasing said delay upon said vertical sync pulses by an increment equal to said period, whereby said delay is changed from an upper limit to a lower limit to implement motion of said characters across said face, said control circuit further including address-incrementing means connected to said addressing means for modifying an initial address thereof upon the attainment of said lower limit by said delay and to said delay-modification means for simultaneously increasing said delay to said upper limit, wherein said characters are decoded by said character generator to have on said face a common character width corresponding to a horizontal scanning interval, said characters being generated to have a common character width corresponding to a horizontal scanning interval equal to an integral multiple of periods and wherein said lower limit is zero.

6. The combination defined in claim 5 wherein said pulse-generating means includes a high-frequency pulse generator and frequency-divider means connected thereto for feeding to said character generator a pulse sequence for enabling the emission of said binary signals to said monitor via said transmission means and for determining said width, said control circuit being operatively connected to said frequency-divider means for disabling upon said horizontal sync pulses the emission of said sequence for a time equal to said delay and for calculating, in response to a signal from said frequency-divider means coding the magnitude of said scanning interval and in response to said train, an increment count necessary to change said delay from said upper limit to said lower limit.

7. The combination defined in claim 6 wherein said frequency divider means includes a first frequency divider for determining said width and a second frequency divider for determining the speed of character motion across said face, further comprising first selector means inserted between said first frequency divider and said character generator for varying the frequency of said sequence, thereby adjusting said width, and second selector means inserted between said second frequency divider and said control circuit for varying the frequency of said train, thereby adjusting the speed of character motion.

8. The combination defined in claim 7 wherein said delay-modification means include a first counter connected at a stepping input to said pulse-generating means for changing the magnitude of said delay upon said vertical sync pulses and a second counter connected to said pulse-generating means and to said first counter for being reset upon each horizontal sync pulse to have a modulus corresponding to the contents of said first counter, said second counter being connected at a stepping input to said second selector and at an output to said first frequency divider for enabling same upon counting a number of pulses of said train equal to said modulus.

9. The combination defined in claim 8 wherein said control circuit further includes arithmetic divider means connected to said first selector, said second selector and said first counter for changing the modulus thereof in response to changes in the frequencies of said train and said sequence, thereby minimizing jumps in character movement.

10. The combination defined in claim 8 or 9 wherein said first counter has an output connected to said addressing means for incrementing an initial address thereof upon the counting of consecutive vertical sync pulses equal in number to the modulus of said first counter.

* * * * *